US009304479B1

(12) United States Patent
Shimizu et al.

(10) Patent No.: US 9,304,479 B1
(45) Date of Patent: Apr. 5, 2016

(54) IMAGE FORMING APPARATUS

(71) Applicant: KYOCERA Document Solutions Inc., Osaka-shi, Osaka (JP)

(72) Inventors: Tamotsu Shimizu, Osaka (JP); Ryo Taniguchi, Osaka (JP); Akifumi Yamaguchi, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/879,782

(22) Filed: Oct. 9, 2015

(30) Foreign Application Priority Data

Oct. 14, 2014 (JP) ..... 2014-209647

(51) Int. Cl.
*G03G 21/00* (2006.01)
*G03G 15/08* (2006.01)

(52) U.S. Cl.
CPC ..... *G03G 21/0058* (2013.01); *G03G 15/0808* (2013.01); *G03G 15/0815* (2013.01); *G03G 21/0064* (2013.01)

(58) Field of Classification Search
CPC ..... G03G 21/0058; G03G 21/0064; G03G 15/0815; G03G 15/0808
See application file for complete search history.

(56) References Cited

U.S. PATENT DOCUMENTS 6,055,401 A * 4/2000 Tonomoto ..... G03G 15/09 399/269
9,207,583 B1 * 12/2015 Shimizu ..... G03G 15/0812
2004/0141770 A1 * 7/2004 Maeda ..... G03G 15/0291 399/159
2007/0212123 A1 * 9/2007 Kabashima ..... G03G 15/0914 399/269
2010/0080611 A1 * 4/2010 Kurachi ..... G03G 15/0818 399/111
2015/0293470 A1 * 10/2015 Shimizu ..... G03G 15/0808 399/265
2015/0331354 A1 * 11/2015 Shimizu ..... G03G 15/0813 399/279

FOREIGN PATENT DOCUMENTS

JP 2014081405 A 5/2014

* cited by examiner

*Primary Examiner* — Rodney Bonnette
(74) *Attorney, Agent, or Firm* — Alleman Hall McCoy Russell & Tuttle LLP

(57) ABSTRACT

In an image forming apparatus, a coating layer of each of a photoconductor drum and a collecting roller has been formed by a dipping method in which a base body of each of the photoconductor drum and the collecting roller is dipped in a liquid in a state where the base body is in a vertical attitude such that a first end of the base body faces down and a second end of the base body faces up. The collecting roller is supported in a state where the first end of the collecting roller base body and the second end of the drum base body face a same direction.

4 Claims, 3 Drawing Sheets

IMAGE FORMING APPARATUS

INCORPORATION BY REFERENCE

This application is based upon and claims the benefit of priority from the corresponding Japanese Patent Application No. 2014-209647 filed on Oct. 14, 2014, the entire contents of which are incorporated herein by reference.

BACKGROUND

The present disclosure relates to an electrophotographic image forming apparatus.

In general, an electrophotographic image forming apparatus includes a photoconductor drum, a charging roller, and a developing portion. The photoconductor drum carries an image. The charging roller charges the photoconductor drum. The developing portion develops an electrostatic latent image on the surface of the photoconductor drum. The photoconductor drum includes a base body and a coating layer. The base body has a cylindrical outer circumferential surface. The coating layer is formed on the outer circumferential surface of the base body, and includes a charge transport material. Hereinafter, the coating layer of the photoconductor drum is referred to as a drum coating layer.

In addition, the developing portion of the image forming apparatus includes a developing roller for supplying developer to the photoconductor drum. Furthermore, in case the developer is two-component developer that includes carrier, the developing portion may include a carrier collecting roller for collecting particles of the carrier that have moved to the surface of the photoconductor drum.

SUMMARY

An image forming apparatus according to an aspect of the present disclosure includes a photoconductor drum and a developing portion. The photoconductor drum is configured to carry a toner image while rotating. The developing portion includes a developing roller and a collecting roller. The photoconductor drum includes: a drum base body having a cylindrical outer circumferential surface; and a drum coating layer formed on the outer circumferential surface of the drum base body. The drum coating layer includes a charge transport material. The drum coating layer has been formed by a dipping method in which the drum base body is dipped in a first liquid in a state where the drum base body is in a vertical attitude such that a first end of the drum base body faces down and a second end of the drum base body faces up. The developing roller supplies charged toner to the photoconductor drum. The collecting roller is rotatably supported, in a state of not contacting the photoconductor drum, at a position more on a downstream side in a rotation direction of the photoconductor drum than the developing roller. A bias is applied to the collecting roller, wherein a polarity of a potential difference of the bias to the photoconductor drum is the same as a charging polarity of the toner. The collecting roller includes: a collecting roller base body having a cylindrical outer circumferential surface; and a collecting roller coating layer formed on the outer circumferential surface of the collecting roller base body. The collecting roller coating layer has been formed by the dipping method in which the collecting roller base body is dipped in a second liquid in a state where the collecting roller base body is in a vertical attitude such that a first end of the collecting roller base body faces down and a second end of the collecting roller base body faces up. The collecting roller is supported in a state where the collecting roller and the photoconductor drum are opposed to each other and the first end of the collecting roller base body and the second end of the drum base body face a same direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following embodiments are examples of specific embodiments of the present disclosure and should not limit the technical scope of the present disclosure.

First Embodiment

Figure 1:
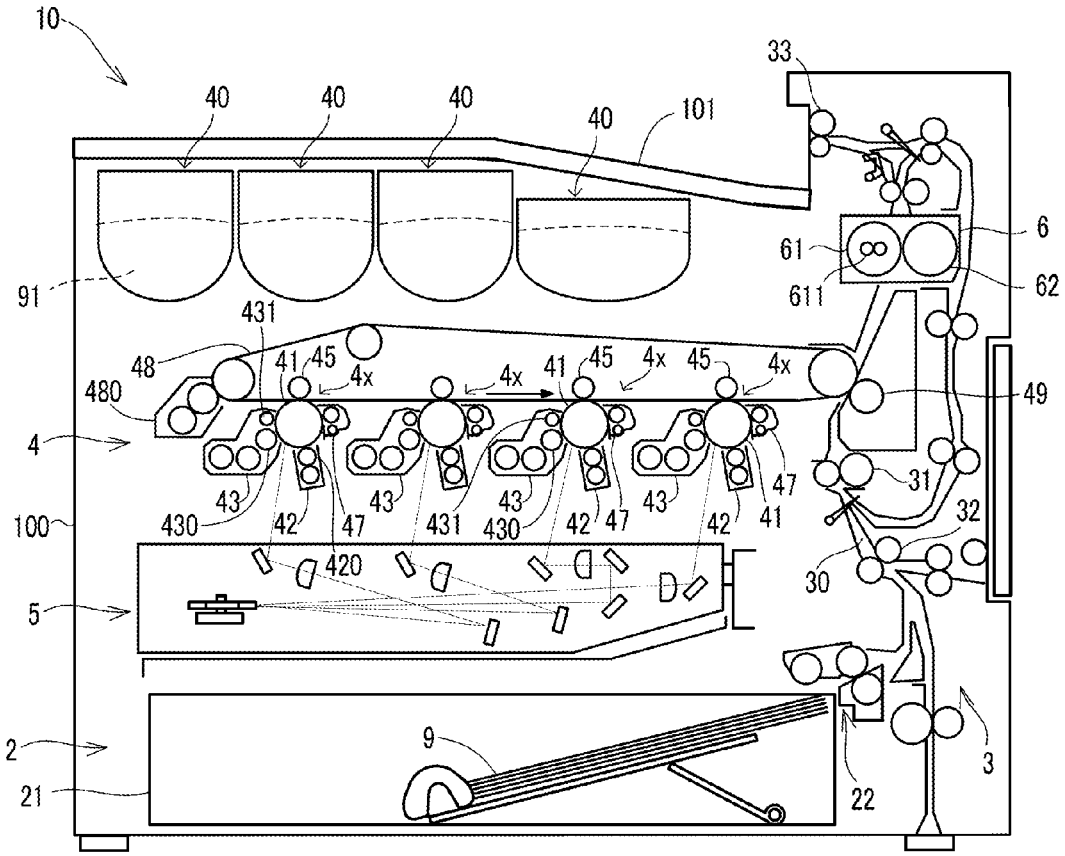
FIG. 1 is a configuration diagram of an image forming apparatus according to the first embodiment of the present disclosure.
Figure 2:
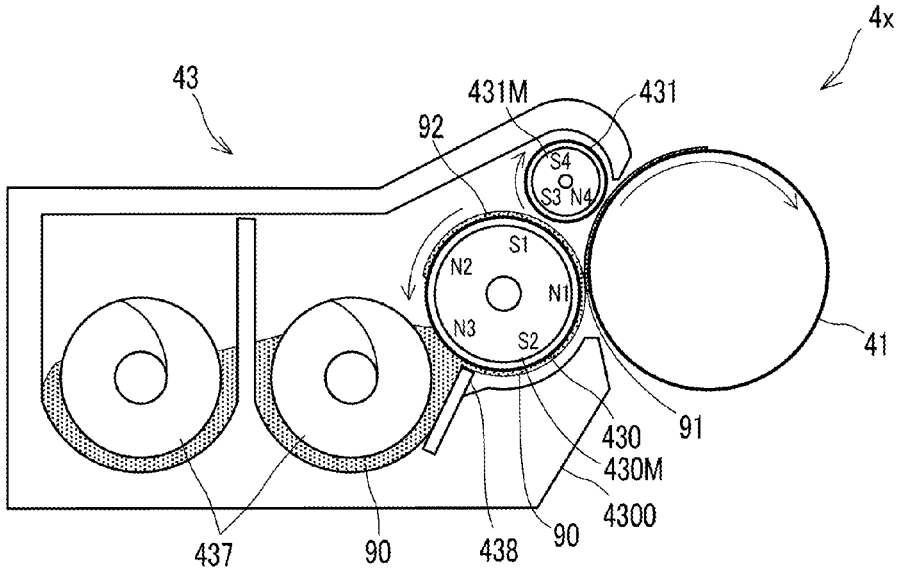
FIG. 2 is a configuration diagram of a photoconductor drum and a developing device in an image forming portion of the image forming apparatus according to the first embodiment of the present disclosure.

First, a description is given of an image processing apparatus 10 according to the first embodiment of the present disclosure with reference to FIGS. 1 and 2. The image processing apparatus 10 is an electrophotographic image forming apparatus. As shown in FIG. 1, the image forming apparatus 10 includes, in a housing 100, a sheet supply portion 2, a sheet conveying portion 3, toner supply portions 40, an image forming portion 4, an optical scanning portion 5, and a fixing portion 6.

The image forming apparatus 10 shown in FIG. 1 is a tandem image forming apparatus and is a color printer. As a result, the image forming portion 4 includes an intermediate transfer belt 48, a secondary cleaning device 480, and a secondary transfer device 49.

In addition, the image forming portion 4 includes a plurality of single-color image forming portions 4*x* that respectively correspond to the colors of cyan, magenta, yellow, and black. Furthermore, the image forming apparatus 10 includes a plurality of toner supply portions 40 that supply toner 91 of the colors cyan, magenta, yellow, and black respectively to a plurality of developing devices 43 that are described below.

It is noted that the image forming apparatus 10 is, for example, a printer, a copier, a facsimile, or a multifunction peripheral. The multifunction peripheral has a function of the printer, a function of the copier, and the like.

The sheet supply portion 2 includes a sheet receiving portion 21 and a sheet feed portion 22. The sheet receiving portion 21 is configured to store a plurality of recording sheets 9 stacked therein. It is noted that the recording sheet 9 is a sheet-like image formation medium such as a sheet of paper, a sheet of coated paper, a postcard, an envelope, or an OHP sheet.

The sheet feed portion 22 is configured to feed a recording sheet 9 from the sheet receiving portion 21 to a conveyance path 30, by rotating while in contact with the recording sheet 9.

The sheet conveyance portion 3 includes a registration roller 31, a conveyance roller 32, and a discharge roller 33. The registration roller 31 and the conveyance roller 32 convey the recording sheet 9 supplied from the sheet supply portion 2, to the secondary transfer device 49 of the image forming portion 4. Furthermore, the discharge roller 33 discharges the recording sheet 9 after image formation, onto a discharge tray 101 from a discharge port of the conveyance path 30.

The intermediate transfer belt 48 is an endless belt-like member formed in the shape of a loop. The intermediate transfer belt 48 is rotated in the state where it is suspended between two rollers. In the image forming portion 4, the single-color image forming portions 4*x* form images of respective colors on the surface of the rotating intermediate transfer belt 48. With this operation, the images of different colors are overlaid and a color image is formed on the intermediate transfer belt 48.

The secondary transfer device 49 transfers the toner image formed on the intermediate transfer belt 48 to the recording sheet 9. The secondary cleaning device 480 removes toner that remains after the transfer by the secondary transfer device 49, from the intermediate transfer belt 48. The fixing portion 6 nips the recording sheet 9 with an image formed thereon, between a heating roller 61, in which is embedded a heater 611, and a pressure roller 62 and feeds the sheet to a downstream process. In this operation, the fixing portion 6 heats the developer on the recording sheet 9 and fixes the image to the recording sheet 9.

Each of the single-color image forming portions 4*x* includes a photoconductor drum 41 that carries a toner image, a charging device 42, a developing device 43, a primary transfer device 45, and a primary cleaning device 47. The photoconductor drum 41 is an example of the image carrier that carries a toner image while rotating.

The photoconductor drums 41 rotate at a peripheral speed (moving speed) that corresponds to a peripheral speed of the intermediate transfer belt 48. The photoconductor drum 41 may be, for example, an organic photoconductor. In addition, the photoconductor drum 41 may be an amorphous silicon photoconductor.

In each of the single-color image forming portions 4*x*, the photoconductor drum 41 rotates, and the charging device 42 uniformly charges the surface of the photoconductor drum 41. Furthermore, the optical scanning portion 5 writes an electrostatic latent image on the charged surface of the photoconductor drum 41 by scanning a laser beam thereon.

The developing device 43 develops the electrostatic latent image by supplying the toner 91 to the photoconductor drum 41. The developing device 43 of the present embodiment charges the toner 91 by stirring two-component developer 90 that includes the toner 91 and carrier 92, and supplies the charged toner 91 to the photoconductor drum 41. It is noted that the developing device 43 is an example of the developing device.

The carrier 92 is a granular material having magnetism. The carrier 92 may be, for example, a granular material including magnetic body particles which are each coated with a film of synthetic resin such as epoxy resin.

The charging device 42 includes a charging roller 420 that charges the photoconductor drum 41 before the electrostatic latent image is written thereon.

As shown in FIG. 2, the developing device 43 includes a developing tank 4300, a developing roller 430, a collecting roller 431, a stirring member 437, and a blade 438. Furthermore, the developing device 43 includes a conveyance magnet 430M and a collection magnet 431M. The conveyance magnet 430M is supported so as to be rotatable in the developing roller 430. The collection magnet 431M is supported so as to be rotatable in the collecting roller 431.

The developing tank 4300 is a container for storing the two-component developer 90. The developing roller 430, the collecting roller 431, and the stirring member 437 rotate in the developing tank 4300. Each of the developing roller 430 and the collecting roller 431 is rotatably supported in the state of being opposed to and not contacting the photoconductor drum 41. The collecting roller 431 is supported at a position more on the downstream side in the rotation direction of the photoconductor drum 41 than the developing roller 430.

During the developing operation, the collecting roller 431 rotates in the same direction as the photoconductor drum 41, and the developing roller 430 rotates in the reverse direction to the photoconductor drum 41. As a result, the parts of the outer circumferential surfaces of the developing roller 430 and the photoconductor drum 41 that correspond to each other rotate in the same direction. In addition, the parts of the outer circumferential surfaces of the collecting roller 431 and the photoconductor drum 41 that correspond to each other rotate in reverse directions to each other.

The stirring member 437 stirs the two-component developer 90 in the developing tank 4300. With this stirring, the toner 91 is charged to a predetermined polarity. In addition, the carrier 92 is charged to a polarity that is opposite to the charging polarity of the toner 91. However, a part of the toner 91 may not be charged sufficiently, or may be charged to a polarity that is opposite to a predetermined polarity. In the following description, such part of the toner 91 is referred to as a charging failure toner.

In the present embodiment, the developing roller 430 is an example of the two-component developer carrier that carries the stirred two-component developer 90. The developing roller 430 supplies the charged toner 91 among the two-component developer 90 carried thereby, to the photoconductor drum 41.

More specifically, the developing roller 430 adsorbs and holds the carrier 92 by the action of the magnetic force of the conveyance magnet 430M that is embedded in the developing roller 430. Furthermore, the developing roller 430 moves the toner 91 to the electrostatic latent image on the outer circumferential surface of the photoconductor drum 41, by the action of the applied developing bias. This allows the electrostatic latent image to be developed as a toner image.

The blade 438 restricts the thickness of the two-component developer 90 that has adhered to the surface of the developing roller 430.

A bias is applied to the developing roller 430, wherein the polarity of the potential difference of the bias to the electrostatic latent image on the photoconductor drum 41 is the same as the charging polarity of the toner 91, and the polarity of the potential difference of the bias to the part of the photoconductor drum 41 other than the electrostatic latent image is opposite to the charging polarity of the toner 91. As a result, the charged toner 91 adheres to the electrostatic latent image on the photoconductor drum 41, but not to the other part. In addition, the carrier 92 is held on the developing roller 430 by the suction force of the conveyance magnet 430M.

There is a possibility, however, that a small amount of carrier 92 may move to the photoconductor drum 41 against the suction force of the conveyance magnet 430M. In addition, the charging failure toner may float between the developing roller 430 and the photoconductor drum 41, or adhere to the part of the photoconductor drum 41 other than the electrostatic latent image.

A bias is applied to the collecting roller 431, wherein the polarity of the potential difference of the bias to the photoconductor drum 41 is the same as the charging polarity of the toner 91. The bias applied to the collecting roller 431 allows a force to act on the charging failure toner and the small amount of carrier 92 that has moved to the photoconductor drum 41 such that they are attracted toward the collecting roller 431. Furthermore, the collection magnet 431M generates, in the photoconductor drum 41 side, a magnetic field that attracts the carrier 92.

As a result, the collecting roller 431 attracts and collects the charging failure toner and the carrier 92 that has moved to the photoconductor drum 41.

Suppose, for example, that the electrostatic latent image on the surface of the photoconductor drum 41 has a potential difference of +100V and the other part of the surface of the photoconductor drum 41 has a potential difference of +430V, the developing vias that is the potential of the developing roller 430 is +300V, and a collection vias that is the potential of the collecting roller 431 is +700V. In addition, the charging polarity of the toner 91 is positive (+) and the charging polarity of the carrier 92 is negative (−).

In the above-described case, the potential difference of the collecting roller 431 to the photoconductor drum 41 is +270V to +600V, and its polarity is the same as the charging polarity of the toner 91. In this case, the carrier 92 that has moved to the photoconductor drum 41 and the charging failure toner that is present between the photoconductor drum 41 and the collecting roller 431 are attracted toward the collecting roller 431 by the collection bias.

Furthermore, the carrier 92 and the charging failure toner captured by the collecting roller 431 are separated from the collecting roller 431 by the action of a same-polarity magnetized portion (the S3 pole and the S4 pole in FIG. 2) in the collection magnet 431M embedded in the collecting roller 431. The carrier 92 and the charging failure toner separated from the collecting roller 431 are collected in the developing tank 4300 directly or after moving to the developing roller 430.

As shown in FIG. 2, the part of the collection magnet 431M of the collecting roller 431 and the part of the conveyance magnet 430M of the developing roller 430 that are opposed to each other have poles of the same polarity (the S3 pole and the S1 pole in FIG. 2).

It is noted that if the part of the collection magnet 431M and the part of the conveyance magnet 430M that are opposed to each other have poles of different polarities, a magnetic brush is formed between the poles. That is not desirable since development of the toner 91 or the carrier 92 will occur between the developing roller 430 and the collecting roller 431.

In the example shown in FIG. 2, the collecting roller 431 is positioned above the developing roller 430. However, the collecting roller 431 may be positioned below the developing roller 430. In that case, too, the magnetic relationship between the parts that are opposed to each other is the same as that described above. However, when the collecting roller 431 is positioned below the developing roller 430, the carrier 92 on the collecting roller 431 does not move to the developing roller 430, but is directly collected in the developing tank 4300.

It is noted that a toner removing member that contacts the collecting roller 431 may be provided in the case where only the charging failure toner needs to be collected, but not the carrier 92. The toner removing member mechanically removes the charging failure toner from the collecting roller 431. The toner removing member is, for example, a scraper, a brush, or a foamed roller.

[Configuration of Photoconductor Drum 41]

Next, the configuration of the photoconductor drum 41 is described with reference to FIG. 3. The photoconductor drum 41 includes a base body and a coating layer, wherein the base body includes a cylindrical outer circumferential surface 411*s*, and the coating layer is formed on the outer circumferential surface 411*s* and includes a charge transport material. Hereinafter, the base body of the photoconductor drum 41 is referred to as a drum base body 411, and the coating layer of the photoconductor drum 41 is referred to as a drum coating layer 412. The photoconductor drum 41 may be, for example, an organic photoconductor.

The drum base body 411 is a cylindrical member that is made of, for example, a metal whose main component is aluminum. The drum coating layer 412 of the photoconductor drum 41 is a thin-film layer including at least a charge transport material. In the present embodiment, the drum coating layer 412 is a photosensitive layer including a charge transport material and a charge generation material. The charge transport material may be, for example, a material that includes a fluorenone-based compound, a nitro compound, a hydrazone compound, an oxadiazole compound. a styryl-based compound, a carbazole-based compound, or a pyrazoline-based compound.

It is noted that, as another adoptable configuration of the photoconductor drum 41, the drum coating layer 412 and a photosensitive layer may be formed individually, wherein the drum coating layer 412 includes the charge transport material and the photosensitive layer includes a photosensitive material. In addition, as a still another adoptable configuration of the photoconductor drum 41, the drum coating layer 412, a photosensitive layer, and another coating layer may be formed individually, wherein the drum coating layer 412 includes the charge transport material and the photosensitive layer includes a photosensitive material. In that case, the layers other than the drum coating layer 412 may be formed by spray coating method.

The drum coating layer 412 is formed on the outer circumferential surface 411*s* of the drum base body 411 by the dipping method. In the formation process of the drum coating layer 412 by the dipping method, the drum base body 411 is dipped in a liquid that includes the material of the drum coating layer 412, in a state where the drum base body 411 is in a vertical attitude such that a first end 41*x* of the drum base body 411 faces down and a second end 41*y*, which is opposite to the first end 41*x* in the longitudinal direction of the photoconductor drum 41, faces up. It is noted that the liquid including the material of the drum coating layer 412 is an example of the first liquid.

Figure 3:
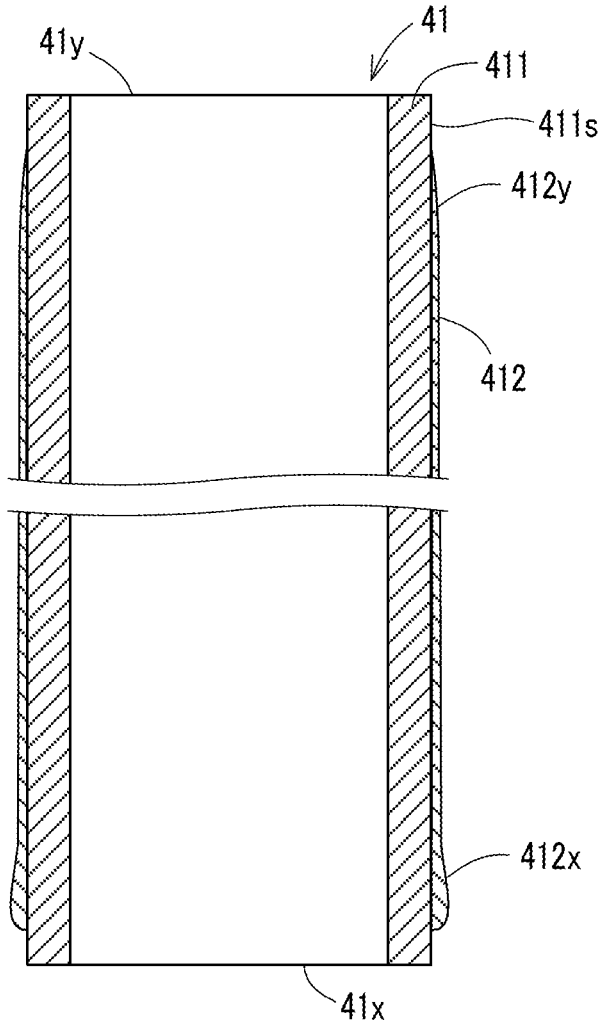
FIG. 3 is a cross-sectional view of the photoconductor drum of the image forming apparatus according to the first embodiment of the present disclosure.

FIG. 3 is a partially omitted cross-sectional view of the photoconductor drum 41 on which the drum coating layer 412 has been formed by the dipping method. In the dipping process, when the drum base body 411 is dipped in the liquid while it is in the vertical attitude, a part of the drum coating layer 412 on the first end 41*x* side tends to be larger in thickness than a part on the second end 41*y* side in the longitudinal direction of the photoconductor drum 41.

The above-described thickness distribution tendency of the drum coating layer 412 is prominently observed in a part 412*x* on the first end 41*x* side and a part 412*y* on the second end 41*y* side on the drum base body 411. Such a thickness distribution tendency of the drum coating layer 412 is common to coating layers that are formed by the dipping method on the surfaces of the members having cylindrical outer circumferential surfaces.

In the photoconductor drum 41, the drum coating layer 412 is formed in an intermediate area on the outer circumferential surface 411*s* of the drum base body 411, excluding areas at the opposite ends of the photoconductor drum 41. That is, the drum coating layer 412 is not formed in the areas at the opposite ends of the outer circumferential surface 411*s* of the drum base body 411.

Meanwhile, as described above, the thickness of the drum coating layer 412 formed on the outer circumferential surface 411*s* of the drum base body 411 is uneven in the longitudinal direction of the drum base body 411. That is, in the drum coating layer 412, a lower part in the dipping tends to be larger in thickness than an upper part in the dipping.

As a result, in the case where the drum coating layer 412 is formed by the dipping method, when a cylindrical carrier collecting roller of a typical type is adopted, the distance between the outer circumferential surfaces of the photoconductor drum 41 and the cylindrical carrier collecting roller becomes uneven in the longitudinal direction thereof.

That is, the distance between the outer circumferential surfaces of the photoconductor drum 41 and the cylindrical carrier collecting roller is larger in an area where the drum coating layer 412 is thin than in an area where the drum coating layer 412 is thick. As a result, the performance of collecting the carrier 92 is degraded in the area where the distance between the outer circumferential surfaces of the photoconductor drum 41 and the cylindrical carrier collecting roller is large. Not limited to the carrier collecting roller, this problem may also occur to a toner collecting roller that collects the charging failure toner that has failed to move from the developing device 43 to the photoconductor drum 41.

On the other hand, the image forming apparatus 10 can solve the above-described problem since the collecting roller 431 is configured as described below. That is, according to the image forming apparatus 10, in the case where the drum coating layer 412 of the photoconductor drum 41 is formed by the dipping method, it is possible to prevent degradation of the performance of the collecting roller 431 of the developing device 43 in collecting particles of the carrier 92 of the two-component developer 90 or the charging failure toner.

[Configuration of Collecting Roller 431]

Figure 4:
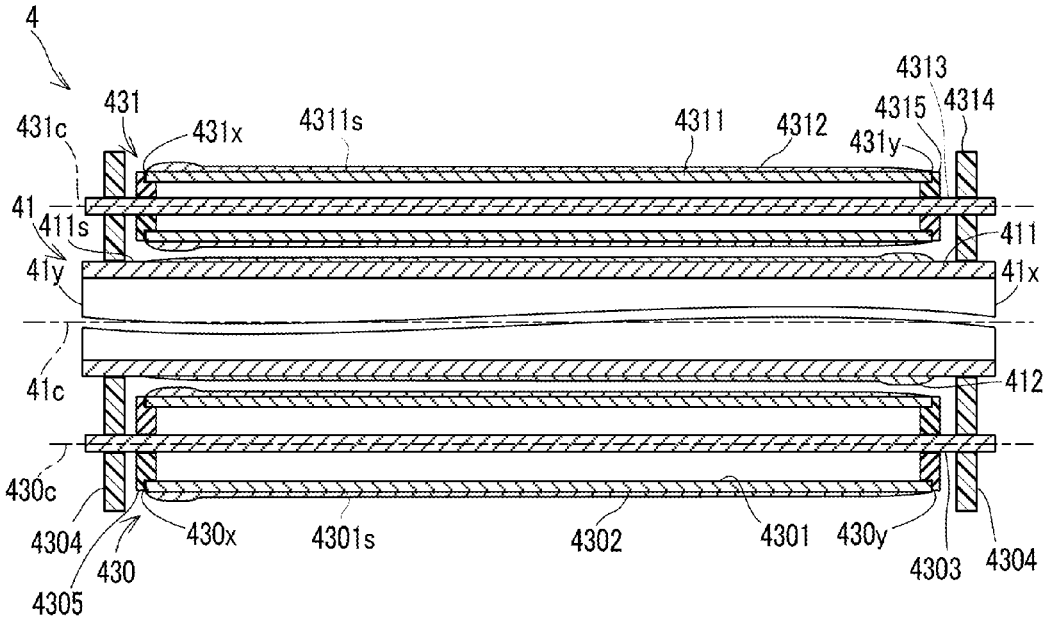
FIG. 4 is a cross-sectional view of the photoconductor drum, a developing roller, and a collecting roller in the image forming portion of the image forming apparatus according to the first embodiment of the present disclosure.

Next, the configuration of the collecting roller 431 is described with reference to FIG. 4. FIG. 4 is a cross-sectional view of the photoconductor drum 41, the developing roller 430, and the collecting roller 431 in the image forming portion 4.

The collecting roller 431 includes a collecting roller base body 4311 and a collecting roller coating layer 4312, wherein the collecting roller base body 4311 includes a cylindrical outer circumferential surface 4311*s*, and the collecting roller coating layer 4312 is formed on the outer circumferential surface 4311*s*. Furthermore, the collecting roller 431 includes a shaft portion 4313 that passes through the collecting roller base body 4311 in the longitudinal direction thereof. As a result, the collecting roller base body 4311 is cylindrical.

The shaft portion 4313 of the collecting roller 431 is rotatably supported by a support portion (not shown). The collecting roller 431 is supported in the non-contact state where the outer circumferential surface of the collecting roller 431 is separated away from the outer circumferential surface of the photoconductor drum 41 by a small distance.

As one example, disk-shaped spacers 4314 that are respectively attached to opposite ends of the shaft portion 4313 of the collecting roller 431 contact the outer circumferential surface 411*s* of the drum base body 411 respectively at opposite ends thereof. The disk-shaped spacers 4314 maintain a constant distance between the photoconductor drum 41 and the collecting roller 431. The disk-shaped spacers 4314 contact the photoconductor drum 41 at opposite areas outside the image forming area.

In addition, the photoconductor drum 41 and the collecting roller 431 are rotatably supported in the state where a rotation center line 41*c* of the photoconductor drum 41 and a rotation center line 431*c* of the collecting roller 431 are parallel to each other.

The collecting roller coating layer 4312 is formed on the outer circumferential surface 4311*s* of the collecting roller base body 4311 by the dipping method. As one example, the collecting roller coating layer 4312 is formed on the most outside of the outer circumferential surface 4311*s* of the collecting roller base body 4311.

The collecting roller coating layer 4312 formed by the dipping method is thinner in layer thickness than formed by the spray coating method. This makes it possible to make the collecting roller 431 closer to the photoconductor drum 41. As a result, the efficiency of the collecting roller 431 in collecting the carrier 92 and the charging failure toner is increased.

In the dipping process for forming the collecting roller coating layer 4312, the collecting roller base body 4311 is dipped in a liquid that includes the material of the collecting roller coating layer 4312, in a state where the collecting roller base body 4311 is in a vertical attitude such that a first end 431*x* of the collecting roller base body 4311 faces down and a second end 431*y*, which is opposite to the first end 431*x* in the longitudinal direction of the collecting roller base body, faces up. It is noted that the liquid including the material of the collecting roller coating layer 4312 is an example of the second liquid.

The collecting roller base body 4311 is a cylindrical member that is made of, for example, a metal whose main component is aluminum. The collecting roller coating layer 4312 includes, for example, a layer of alcohol-soluble nylon and conductive powder that is distributed in the layer of alcohol-soluble nylon. In this case, the conductive powder may be titanium oxide powder.

When the collecting roller coating layer 4312 including alcohol-soluble nylon is formed on the most outside layer of the collecting roller 431, the collected carrier 92 and charging failure toner are easily removed from the collecting roller 431. As a result, the captured particles are prevented from accumulating on the surface of the collecting roller 431, and the captured particles are collected in the developing tank 4300 in a more reliable manner.

In the collecting roller 431, opposite ends of the collecting roller base body 4311 are fixed to the shaft portion 4313 by fixing members 4315.

When the collecting roller base body 4311 is made of a metal whose main component is aluminum, the outer circumferential surface 4311*s* of the collecting roller base body 4311 may be an alumite layer formed by an oxidization treatment of alumimum. In that case, the collecting roller coating layer 4312 is formed directly above the alumite layer. This generates the so-called anchor effect and makes it difficult for the collecting roller coating layer 4312 to be removed from the collecting roller base body 4311.

The following describes a specific example of the method of forming the collecting roller coating layer 4312. First, a process is performed to form an oxidized film on the surface of the collecting roller base body 4311 before the formation of the collecting roller coating layer 4312.

As one example, an alumite treatment is performed to form an alumite layer on the outer circumferential surface 4311*s* of the collecting roller base body 4311 that is made of a metal whose main component is aluminum. In this alumite treatment, the alumite layer that is approximately 10 micrometer thick is formed.

Furthermore, a heat treatment process is performed on the alumite layer that is the oxidized film formed on the collecting roller base body 4311. In the heat treatment process, heating to a predetermined constant temperature is continued for a predetermined time period. This makes it possible to generate cracks in a uniformed manner over the whole area of the alumite layer of the collecting roller base body 4311. As one example, in the heat treatment process, the alumite layer is heated to a temperature of approximately 120° C. for a time period of more than 10 minutes.

The heat treatment process for the alumite layer is performed for the purpose of causing cracks to be generated on the alumite layer in advance before the dipping process for the collecting roller coating layer 4312. This prevents cracks from being newly generated on the alumite layer of the collecting roller base body 4311 in the drying process of the collecting roller coating layer 4312 that is executed later.

Furthermore, the dipping process is performed on the outer circumferential surface 4311*s* of the collecting roller base body 4311 on which the alumite layer has been formed, so that a resin coating layer is formed thereon. In this dipping process, the collecting roller base body 4311 is, in the above-mentioned vertical attitude, dipped in a mixed liquid that includes a binding resin and a conductive powder.

As one example, the binding resin may be alcohol-soluble nylon and the conductive powder may be titanium oxide powder. In addition, the dispersion medium of the mixed liquid may be 800 pts.wt. methanol. In that case, the mixed liquid is obtained by mixing the nylon, the titanium oxide and the 800 pts.wt. methanol with, for example, 1.0 mm diameter zirconia beads.

Finally, a drying process is performed to dry the conductive resin coating layer that has been formed on the collecting roller base body 4311 in the dipping process. As one example, in the drying process, the conductive resin coating layer is dried for approximately 10 minutes in an environment of approximately 130° C. In this process, the collecting roller coating layer 4312 with a thickness of approximately 2-11 micrometers is obtained.

Meanwhile, when cracks are generated in the alumite layer during the drying process, the conductive powder is likely to be distributed unevenly in the resin coating layer by the influence of the convection.

As described above, however, when cracks are generated on the alumite layer in advance during the heat treatment process, it is possible to prevent cracks from being newly generated on the alumite layer during the drying process. As a result, in the drying process, the conductive powder is evenly distributed in the resin coating layer. This makes it possible to form the collecting roller coating layer 4312 as a homogeneous layer.

As is the case with the drum coating layer 412, a part of the collecting roller coating layer 4312 on the first end 431*x* side tends to be larger in thickness than a part on the second end 431*y* side in the longitudinal direction of the collecting roller 431.

As shown in FIG. 4, the collecting roller 431 is supported in the state where the collecting roller 431 and the photoconductor drum 41 are opposed to each other and the first end 431*x* of the collecting roller base body 4311 and the second end 41*y* of the drum base body 411 face the same direction.

In the image forming apparatus 10, the photoconductor drum 41 and the collecting roller 431 are disposed such that they are reversely arranged with respect to the thickness distribution tendency of the coating layer in the longitudinal direction, namely, such that a part of the photoconductor drum 41 where the coating layer is thick is opposite to a part of the collecting roller 431 where the coating layer is thick in the longitudinal direction of the photoconductor drum 41. In this case, the thickness distribution of the drum coating layer 412 and the thickness distribution of the collecting roller coating layer 4312 cancel each other. As a result, the distance between the outer circumferential surfaces of the collecting roller 431 and the photoconductor drum 41 becomes approximately even in the longitudinal direction of the collecting roller 431, with, in particular, no area where the distance is large.

Consequently, in the case where the drum coating layer 412 of the photoconductor drum 41 is formed by the dipping method, it is possible to prevent degradation of the performance of the collecting roller 431 in collecting particles of the carrier 92 of the two-component developer 90 or the charging failure toner. It is thus possible to prevent particles of the carrier 92 or the charging failure toner from scattering.

The effectiveness of the configuration and disposition of the photoconductor drum 41 and the collecting roller 431 shown in FIG. 4 was confirmed by, for example, an evaluation experiment for comparing an evaluation-target apparatus and a comparison apparatus, as described in the following. The evaluation-target apparatus is the image forming apparatus 10 that has adopted the configuration and disposition of the photoconductor drum 41 and the collecting roller 431 that are shown in FIG. 4. On the other hand, the comparison apparatus is an image forming apparatus in which the drum coating layer 412 has been formed on the photoconductor drum 41 by the dipping method, and the collecting roller coating layer 4312 has not been formed on the collecting roller.

The only difference between the evaluation-target apparatus and the comparison apparatus was whether the collecting roller coating layer 4312 was present or absent on the collecting roller. Otherwise, they had the same configuration, and the same operation conditions were applied to both of them. It is noted that in both of the evaluation-target apparatus and the comparison apparatus, the photoconductor drum 41 and the collecting roller were connected to a rotation driving portion only at positions on the side of the first end 41*x* of the drum base body 411.

In the comparison apparatus, the toner 91 had already scattered inside the apparatus when an image formation was performed on 10,000 pieces of recording sheets 9. On the other hand, in the evaluation-target apparatus, scattering of the toner 91 of a recognizable level did not occur even after the image formation was performed on 10,000 pieces of recording sheets 9.

[Configuration of Developing Roller 430]

Next, the configuration of the developing roller 430 is described with reference to FIG. 4. Similar to the collecting roller 431, the developing roller 430 includes a developing roller base body 4301 and a developing roller coating layer 4302, wherein the developing roller base body 4301 includes a cylindrical outer circumferential surface 4301*s*, and the developing roller coating layer 4302 is formed on the outer circumferential surface 4301*s*. Furthermore, the developing roller 430 includes a shaft portion 4303 that passes through the developing roller base body 4301 in the longitudinal direction thereof. As a result, the developing roller base body 4301 is cylindrical.

The shaft portion 4303 of the developing roller 430 is rotatably supported by a support portion (not shown). The developing roller 430 is supported in a non-contact state where the outer circumferential surface of the developing roller 430 is separated away from the outer circumferential surface of the photoconductor drum 41 by a small distance. It is noted that in FIG. 4, the cross sections of the collecting roller 431 and the developing roller 430 are taken along planes of different directions, respectively.

As one example, two disk-shaped spacers 4304 are attached to the shaft portion 4303 of the developing roller 430 so that the disk-shaped spacers 4304 contact the outer circumferential surface 411*s* of the drum base body 411 at opposite ends thereof, respectively. The disk-shaped spacers 4304 maintain a constant distance between the photoconductor drum 41 and the developing roller 430. The disk-shaped spacers 4304 contact the photoconductor drum 41 at areas outside opposite ends of the image forming area.

In addition, the photoconductor drum 41 and the developing roller 430 are rotatably supported in the state where the rotation center line 41*c* of the photoconductor drum 41 and a rotation center line 430*c* of the developing roller 430 are parallel to each other.

The developing roller coating layer 4302 is formed on the outer circumferential surface 4301*s* of the developing roller base body 4301 by the dipping method. As one example, the developing roller coating layer 4302 is formed on the most outside of the outer circumferential surface 4301*s* of the developing roller base body 4301.

The developing roller coating layer 4302 formed by the dipping method is thinner in layer thickness than formed by the spray coating method. As a result, the charge accumulation is difficult to occur on the surface layer of the developing roller 430, and the movement state of the toner 91 from the developing roller 430 to the photoconductor drum 41 varies by a small amount. As a result, the variation of image density is restricted, and image quality becomes stable.

In the formation process of the developing roller coating layer 4302 by the dipping method, the developing roller base body 4301 is dipped in a liquid that includes the material of the developing roller coating layer 4302, in a state where the developing roller base body 4301 is in a vertical attitude such that a first end 430*x* of the developing roller base body 4301 faces down and a second end 430*y*, which is opposite to the first end 430*x* in the longitudinal direction of the developing roller base body 4301, faces up. It is noted that the liquid including the material of the developing roller coating layer 4302 is an example of the third liquid.

In the dipping process, when the developing roller base body 4301 is dipped in the liquid while it is in the vertical attitude, a part of the developing roller coating layer 4302 on the first end 430 side tends to be larger in thickness than a part on the second end 430*y* side in the longitudinal direction of the developing roller 430.

The developing roller base body 4301 is a cylindrical member that is made of, for example, a metal whose main component is aluminum. The developing roller coating layer 4302 is a coating layer formed on the outer circumferential surface 4301*s* of the developing roller base body 4301. The developing roller coating layer 4302 includes, for example, a layer of alcohol-soluble nylon and conductive powder that is distributed in the layer of alcohol-soluble nylon. In this case, the conductive powder may be titanium oxide powder.

In the developing roller 430, opposite ends of the developing roller base body 4301 are fixed to the shaft portion 4303 by fixing members 4305.

When the developing roller base body 4301 is made of a metal whose main component is aluminum, the outer circumferential surface 4301*s* of the developing roller base body 4301 may be an alumite layer formed by an oxidization treatment of aluminum. In that case, the developing roller coating layer 4302 is formed directly above the alumite layer. This generates the so-called anchor effect and makes it difficult for the developing roller coating layer 4302 to be removed from the developing roller base body 4301.

The developing roller coating layer 4302 is formed by the same method as the method for forming the collecting roller coating layer 4312.

As shown in FIG. 4, the developing roller 430 is supported in the state where the developing roller 430 and the photoconductor drum 41 are opposed to each other and the first end 430*x* of the developing roller base body 4301 and the second end 41*y* of the drum base body 411 face the same direction. As a result, the developing roller 430 is supported in the state where the first end 430*x* of the developing roller base body 4301 and the first end 431*x* of the collecting roller base body 4311 face the same direction.

That is, the photoconductor drum 41 and the developing roller 430 are disposed such that they are reversely arranged with respect to the thickness distribution tendency of the coating layer in the longitudinal direction, namely, such that a part of the photoconductor drum 41 where the coating layer is thick is opposite to a part of the developing roller 430 where the coating layer is thick in the longitudinal direction of the photoconductor drum 41. In this case, the thickness distribution of the drum coating layer 412 and the thickness distribution of the developing roller coating layer 4302 cancel each other. As a result, the distance between the outer circumferential surfaces of the developing roller 430 and the photoconductor drum 41 becomes approximately even in the longitudinal direction of the developing roller 430, with, in particular, no area where the distance is large. As a result, the variation of developing density in the longitudinal direction of the photoconductor drum 41 is restricted.

Second Embodiment

Figure 5:
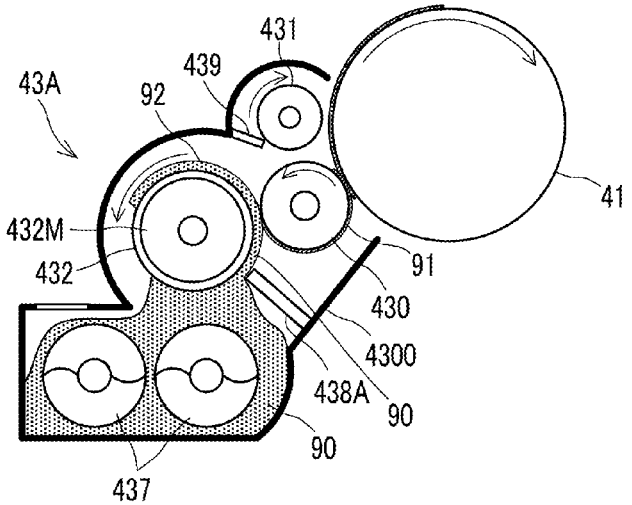
FIG. 5 is a configuration diagram of the photoconductor drum and the developing device in the image forming portion of the image forming apparatus according to the second embodiment of the present disclosure.

Next, a description is given of a developing device 43A of an image processing apparatus according to the second embodiment of the present disclosure with reference to FIG. 5. FIG. 5 is a configuration diagram of the photoconductor drum 41 and the developing device 43A. In FIG. 5, the same components as those shown in FIGS. 1-4 are assigned the same reference signs. The following describes the difference of the developing device 43A of the second embodiment from the developing device 43.

In the developing device 43A of the image forming apparatus according to the second embodiment, the configuration of the collecting roller 431 and the developing roller 430 and the direction thereof relative to the photoconductor drum 41 are the same as those in the developing device 43.

The developing device 43A is different from the developing device 43 in that it does not include the collection magnet 431M and the conveyance magnet 430M, but includes a magnetic roller 432 and an intermediate conveyance magnet 432M. The intermediate conveyance magnet 432M is fixed to the inside of the magnetic roller 432. Furthermore, the developing device 43A includes a blade 438A instead of the blade 438.

The developing device 43A that includes the magnetic roller 432 and the developing roller 430 is a device that develops the electrostatic latent image on the surface of the photoconductor drum 41 by the so-called interactive touch-down method. In the developing device 43A, the collecting roller 431 collects the charging failure toner on the photoconductor drum 41 side. Furthermore, the charging failure toner on the collecting roller 431 is removed from the collecting roller 431 by a toner removing member 439 that is in contact with the surface of the collecting roller 431, and is collected in the developing tank 4300 via the magnetic roller 432.

The intermediate conveyance magnet 432M provided inside the magnetic roller 432 attracts, by its magnetic force, the two-component developer 90 that has been stirred by the stirring member 437. This allows the magnetic roller 432 to carry the stirred two-component developer 90 on its surface. In the present embodiment, the magnetic roller 432 is an example of the two-component developer carrier that carries the two-component developer 90.

The blade 438A restricts the thickness of the two-component developer 90 that has adhered to the surface of the magnetic roller 432.

The magnetic roller 432 supplies the toner 91 among the two-component developer 90 carried thereby, to the developing roller 430. The magnetic roller 432 adsorbs and holds the carrier 92 by the magnetic force of the intermediate conveyance magnet 432M that is embedded in the magnetic roller 432.

A bias is applied to the magnetic roller 432 such that a potential difference is generated between the magnetic roller 432 and the developing roller 430. By the action of the bias, the magnetic roller 432 moves only the charged toner 91, among the two-component developer 90 carried thereby, to the developing roller 430.

The developing roller 430, by the action of the applied developing bias, moves the toner 91 to the electrostatic latent image on the outer circumferential surface of the photoconductor drum 41. This allows the electrostatic latent image to be developed as a toner image.

In the present embodiment, too, the photoconductor drum 41 and the collecting roller 431 are disposed such that they are reversely arranged with respect to the thickness distribution tendency of the coating layer in the longitudinal direction, namely, such that a part of the photoconductor drum 41 where the coating layer is thick is opposite to a part of the collecting roller 431 where the coating layer is thick in the longitudinal direction of the photoconductor drum 41. As a result, the distance between the outer circumferential surfaces of the collecting roller 431 and the photoconductor drum 41 becomes approximately even in the longitudinal direction of the collecting roller 431, with, in particular, no area where the distance is large. As a result, the present embodiment produces the same effect as the first embodiment.

[Application Examples]

The developing devices 43, 43A may be applied to a monochrome image forming apparatus. In addition, the collecting roller 431 may be applied to a developing device of a one-component developing system that develops the electrostatic latent image by using one-component developer that does not include the carrier 92.

It is noted that the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a photoconductor drum configured to carry a toner image while rotating; and a developing portion including a developing roller and a collecting roller, wherein the photoconductor drum includes:

a drum base body having a cylindrical outer circumferential surface; and a drum coating layer formed on the outer circumferential surface of the drum base body and including a charge transport material, the drum coating layer has been formed by a dipping method in which the drum base body is dipped in a first liquid in a state where the drum base body is in a vertical attitude such that a first end of the drum base body faces down and a second end of the drum base body faces up, the developing roller supplies charged toner to the photoconductor drum, the collecting roller is rotatably supported, in a state of not contacting the photoconductor drum, at a position more on a downstream side in a rotation direction of the photoconductor drum than the developing roller, a bias being applied to the collecting roller, a polarity of a potential difference of the bias to the photoconductor drum being same as a charging polarity of the toner, the collecting roller includes:

a collecting roller base body having a cylindrical outer circumferential surface; and a collecting roller coating layer formed on the outer circumferential surface of the collecting roller base body, the collecting roller coating layer has been formed by the dipping method in which the collecting roller base body is dipped in a second liquid in a state where the collecting roller base body is in a vertical attitude such that a first end of the collecting roller base body faces down and a second end of the collecting roller base body faces up, and the collecting roller is supported in a state where the collecting roller and the photoconductor drum are opposed to each other and the first end of the collecting roller base body and the second end of the drum base body face a same direction.

2. The image forming apparatus according to claim 1, wherein the collecting roller coating layer includes a layer of alcohol-soluble nylon and conductive powder that is distributed in the layer of alcohol-soluble nylon.

3. The image forming apparatus according to claim 2, wherein the conductive powder is titanium oxide powder.

4. The image forming apparatus according to claim 1, wherein the developing roller includes:

a developing roller base body having a cylindrical outer circumferential surface; and a developing roller coating layer formed on the outer circumferential surface of the developing roller base body, the developing roller coating layer has been formed by the dipping method in which the developing roller base body is dipped in a third liquid in a state where the developing roller base body is in a vertical attitude such that a first end of the developing roller base body faces down and a second end of the developing roller base body faces up, and the developing roller is supported in a state where the developing roller and the photoconductor drum are opposed to each other and the first end of the developing roller base body and the second end of the drum base body face a same direction.

* * * * *